United States Patent [19]

Toyoda et al.

[11] 4,157,109

[45] Jun. 5, 1979

[54] METHOD FOR MANUFACTURING A MOLD FOR METAL CASTING

[75] Inventors: Atsushi Toyoda; Hiroshi Kasai, both of Hamamatsu, Japan

[73] Assignee: Nippon Gakki Seizo Kabushiki Kaisha, Japan

[21] Appl. No.: 723,558

[22] Filed: Sep. 15, 1976

[30] Foreign Application Priority Data

Sep. 18, 1975 [JP] Japan ..... 50-112958
Feb. 6, 1976 [JP] Japan ..... 51-11902

[51] Int. Cl.[2] ..... B22D 27/16; B29C 1/02

[52] U.S. Cl. ..... 164/7; 164/65; 264/129; 264/220; 264/510; 264/511; 264/517; 264/554; 264/571

[58] Field of Search ..... 264/89, 90, 92, 93, 264/129, 219-221; 164/7, 160, 72, 61, 63, 65

[56] References Cited

U.S. PATENT DOCUMENTS 3,955,266 5/1976 Honami et al. ..... 264/92 X 4,043,376 8/1977 Kasai et al. ..... 164/7

OTHER PUBLICATIONS

"Ionomers", *Modern Plastics Encyclopedia for* 1966, 9-1965, vol. 43/No. 1A, pp. 171, 172.

*Primary Examiner*—Jan H. Silbaugh
*Attorney, Agent, or Firm*—Ostrolenk, Faber, Gerb & Soffen

[57] ABSTRACT

In manufacturing of a mold for metal casting via the vacuum molding process, the cover for the original pattern is made of a synthetic film including, at least partly, ionomer resin component and, further preferably, the exposed surface of the cover set to the pattern is coated with a solution of an initial condensate of a thermosetting resin.

High fidelity in patterning, excellent vacuum retainability, enhanced surface stability and high resistance against thermal decomposition of the ionomer cover film accompanied with considerably reduced casting defects assures high quality of the castings obtained.

12 Claims, 6 Drawing Figures

METHOD FOR MANUFACTURING A MOLD FOR METAL CASTING

Figure 1:
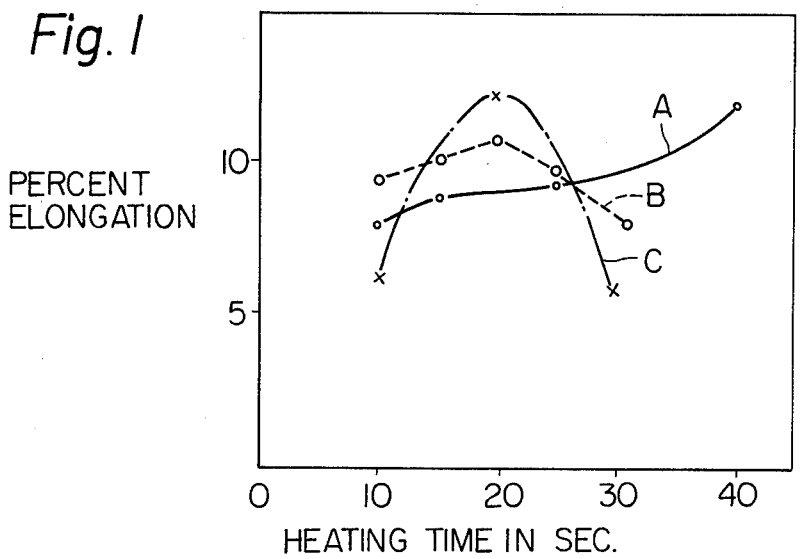

The present invention relates to an improved method for manufacturing a mold for metal casting, and more particularly relates to improvements in the so-called vacuum molding process for metal casting.

It is well known that, in the so-called vacuum molding process for metal casting, a cover made of a resinous film is used for covering the surface of an original pattern. That is, in the molding process, at the outset, the surface of a given pattern is covered snugly by a cover made of a resinous film, a layer of heat resisting granular fillers such as molding sand is formed on the cover film over a prescribed thickness, pneumatic suction is applied to the granular fillers layer for solidification of same and the original pattern is removed, whereby a mold provided with a cavity of a prescribed shape is obtained. In casting, molten metal is cast into the cavity of the mold.

This molding process is based on a principle in which the resinous cover film is sucked snugly onto the granular fillers through application of pneumatic suction to the latter and, after complete solidification of the granular fillers layer, the pattern is removed from the remainder in order to provide a mold having a cavity of the prescribed shape. Therefore, this process is accompanied with prominent advantages that no special mechanical strength is required for the material used for the mold and manufacturing of the casting mold and removal of castings are both very simplified and require considerably reduced time and labour.

As the material for the cover film, films of synthetic resins such as ethylene-vinyl acetate copolymer resin, polyethylene resin, polyvinyl chloride resin and polyvinyl alcohol resin are conventionally used.

However, these conventional synthetic resins are rather insufficient in their physical characteristics as a material for the cover film used for the vacuum molding process. For example, they are rather deficient in their resistances to thermal decomposition and in carbonization effect. Thus, the castings obtained through casting via the vacuum molding process using such cover films are inevitably accompanied with at least one of the fatal casting defects such as gas hole defects, sand marks or sand inclusions, metal penetrations and mold breakdown.

It was confirmed by the inventors of the present invention that the following requirements should be appreciably satisfied in order to carry out metal casting quite successfully while utilizing the vacuum molding process. In the first place, the cover film should have an excellent fidelity in patterning. In other words, the cover film defining the wall of the mold cavity should be faithfully patterned after the surface of the given original pattern. In the second place, the cover film should have an excellent vacuum retainability. In other words, the cover film should be quite firmly, strongly and snugly set onto the granular fillers layer by application of pneumatic suction in order to retain the shape of the mold cavity quite stably. In the third place, the cover film should have an excellent surface stability. In other words, the wall surface of the mold cavity should be maintained quite stably in order even when molten metal is cast into the cavity. In the fourth place, the cover film should have a high resistance against thermal decomposition.

Further explanation will be made in more detail as to the above-described four characteristics required for the cover film in order to carry out metal casting successfully while utilizing the vacuum molding process as follows.

(A) FIDELITY IN PATTERNING

Fidelity in patterning is a factor to indicate how well a cover film can assume the shape of the given original pattern. In order to result an excellent fidelity in patterning, the cover film should satisfy the following requirements.

The range of temperature employable in the thermal treatment of the film should be sufficiently broad. More concretely, dependency of the percent elongation of the film upon the heating time should be small and the decomposition temperature of the film is very high when compared to the softening temperature of same. It is also required that the softening point of the film should be low. This requirement is presented primarily from the view point of processing convenience. As is well known, it is rather difficult in practical mills to keep heating conditions such as heating temperature and heating time always substantially constant. In addition, films used for the cover are very thin and their heat capacities are rather small on the one hand. On the other hand, they are cooled down very quickly at the moment of the pneumatic suction onto the granular fillers layer after softening by heat treatment. So, it is preferable that the melting point of the material film should be rather on the low side.

The tension of the film at softening should be large to a certain extent, the percent elongation of the film should be large and the melting tension should be sufficiently large. These requirements are presented from the following points of view. It is necessary that the cover film should not hang down due to its own weight during heating. It is also necessary that, at the moment of the pneumatic suction to the original pattern, the film can sufficiently and faithfully follow any portion of the pattern surface even when the portion is very complicated in the shape thereof and/or deeply hollowed. It is further necessary that, even when this patterning by pneumatic suction is carried out very quickly, the cover film can form a very thin membrane over the entire surface of the pattern without development of any local breakages.

When the film is subjected to the patterning by pneumatic suction, the film should undergo not elastic deformation but plastic deformation. More concretely, at temperatures above a certain level, the intermolecular bonds of the synthetic resin composing the film should be considerably weakened so as to yield sufficient softening. This requirement is raised for the reason that, in the condition that the mold cavity is set up by the pneumatic suction, the mold cavity should be kept quite free of any accidental deformation which would otherwise be caused by change in the suction force and/or equalization or dispersion of stress in the configuration of the film.

(B) VACUUM RETAINABILITY

In order to result an excellent vacuum retainability, it is basicially required that the film should undergo no local breakages during formation of the mold cavity. Principally, breakage of the film defining the cavity wall naturally leads to breakdown of the mold cavity. However, when the local breakage of the cover film is smaller than certain extent, it does not necessarily cause corresponding instant breakdown of the mold cavity as the granular fillers under the pneumatic suction also have some extent of covering effect. Nevertheless, it is preferred that the cover film should undergo substantially no local breakages during and after formation of the mold cavity. In the case of metal casting accompanied with the vacuum molding process, the gas produced by decomposition of the film tends to develop gas hole defects in the product. For this reason, the thinner the film, the less the gas produced and the fewer the gas hole defects in the end product. From this point of view, a high vacuum retainability is required for the cover film used for the vacuum molding process.

When metal casting is initiated, the molten metal flowing into the cavity initially comes into contact with the surface of the part of the cavity formed in the lower mold half so that the film covering the lower wall portion disappears through burning and is replaced by the molten metal. However, at this beginning stage of the casting, the molten metal does not come into instant contact with the upper wall portion of the cavity as yet and the latter is exposed to the molten metal of an extremely high temperature. During this procedure, if the film covering the upper wall portion instantly disappears before replacement by the molten metal, pneumatic suction acting on the granular fillers layer in the upper mold half will be degraded and mold breakdown may start.

For this reason, it is required that the cover film should melt quickly before contact with the molten metal so that it can well permeate into the granular filler layer due to the pneumatic suction. Whereas, it is required also that the cover film should not be decomposed until it comes into direct contact with the molten metal even through exposed thereto. More concretely, it is required that the cover film has an excellent heat resistance and a high thermal decomposition temperature and the viscosity in molten state should lower very quickly at temperatures above a certain level.

Further, when the film covering the cavity wall starts to disappear through burning from one end thereof, the remaining portion of the film is held to the surface of the granular fillers layer by the pneumatic suction only with the end thereof being in a free state. It is further required that, in this condition, the remaining portion of the film should undergo substantially no shrinkage and maintain the preformed shape of the cavity. In other words, it is required that the cover film should exhibit good plastic deformation and be quite free of thermal shrinkage.

(C) SURFACE STABILITY

When molten metal is cast into the mold cavity, the film covering the cavity wall disappears through burning due to contact with the molten metal. Then, a force acts on the cavity wall surface due to the self-weight and flow of the molten metal and friction between the molten metal and the cavity wall. Therefore, when casting is carried out at a speed higher than a certain level, a portion of the cavity wall is taken off by and mixed into the molten metal flow and the resulting castings contain granular fillers. In other words, the so-called sand marks on sand inclusions is caused. In order to avoid development of such casting defects, it is necessary that no mold breakdown should start even after the cover film has disappeared through burning. That is to say, it is required that the film should be carbonized after permeation into the granular fillers layer through melting, the carbonized film should act as a kind of binder for the granular fillers and the film carbonization should provide the mold with adequate air permeability.

When the molten metal is cast into the mold cavity, the temperature of the molten metal is extremely high, the surface tension of the molten metal is rather small and the permeability thereof is very large. So, when pneumatic suction is applied to the granular fillers layer too strongly, the molten metal may be drawn into the layer of the granular fillers resulting in degraded texture of the produced castings.

In order to successufully avoid such unfavourable molten metal permeation, it is necessary to adjust the strength of the pneumatic suction in reference to the grading of the granular fillers and to chose a film which may be carbonized during casting and form a kind of binder for the granular fillers near the wall surface of the mold cavity.

(D) RESISTANCE TO THERMAL DECOMPOSITION

The smaller the quantity of gas to be produced by thermal decomposition of the cover film through contact with the molten metal of a high temperature, the better is the result of the casting process.

Although a part of the gas may be exhausted out of the mold through the granular fillers layer due to the pneumatic suction, the remainder of the gas prevailing in the cavity disorders smooth flow of the molten metal and will be contained within the resultant castings in the form of gas voids.

In general, the quantity of the gas to be produced is dependent upon the thickness of the cover film. Thus, the thinner the cover film, the less the production of the gas. It is further preferred that the cover film should be carbonized before the thermal decomposition. Even when the thermal decomposition occurs, it is preferred that no corrosive gases such as HCl gas or no harmful gases such as HCN gas or $NO_x$ gas should be produced. Type of gas produced is dependent upon the chemical composition of the cover film. For example, polyvinyl chloride film is unsuitable for use in metal casting via the vacuum molding process as the film produces HCl gas or $Cl_2$ gas through decomposition. It is further preferred that the cover film should leave as little burning dregs as possible because such burning dregs may be contained within the resultant castings, thereby degrading the quality of the latter.

In conclusion, characteristics of the cover film used for metal casting via the vacuum molding process should satisfy the following requirements.

(1) The film should be as thin as possible and perform uniform and complete plastic deformation without any substantial thermal shrinkage.

(2) The film should uphold the shape of the mold cavity at as high temperature as possible. But, once thermal melting starts, it should promptly permeate into the granular fillers layer and be rapidly carbonized therein in order to provide the mold with adequate air permeability.

(3) The film should undergo substantially no thermal decomposition and, after burning, leave substantially no burning dregs. There should be no production of corrosive and/or harmful gases.

It is the primary object of the present invention to provide a method for manufacturing a mold for metal casting which assures reliable and successful production of castings of high quality which are free of casting defects such as gas hole defects, sand marks or sand inclusions and mold breakdown.

It is another object of the present invention to provide a method for manufacturing a mold for metal casting which assures high fidelity in patterning of the cover film to the original pattern.

It is the other object of the present invention to provide a method for manufacturing a mold for metal casting in which, at the time of casting, the cavity wall can well be fortified by by carbonized resin thereby providing the mold with adequate air permeability.

It is a further object of the present invention to provide a method for manufacturing a mold for metal casting which is free of thermal decomposition of the cover film and production of burning dregs and corrosive and/or harmful gases.

In accordance with one aspect of the present invention, the cover film is made of a synthetic film including, at least partly, ionomer resin. The cover film may be made of either ionomer resin solely or ionomer resin admixed with other synthetic resin or resins. The cover may be given in the form of one or more ionomer resin films laminated with other resin film or films.

The term "ionomer resin" used in this specification refers to all types of synthetic polymer resin which are given in the form of ionic copolymers having ionic bridging bonds. Ionomer resins are characterized by a chemical composition in which a metallic ion or ions link molecular chains of copolymers of $\alpha$-olefine with copolymerizable unsaturated carboxylic acid such as acrylic acid, methacrylic acid and maleic acid.

In the chemical composition of ionomer resins, presence of molecular branches linked to the linear high-polymer chain via ionic bonds on one hand assures thermal stability of the resin at relatively low temperatures. On the other hand, however, the ionic bonds linking the molecular chains can be easily dissociated by application of heat when compared to carbonic bonds. So, by heating the cover film at a temperature over a prescribed level, the ionic bonds are easily dissociated and the intermolecular bonds are promptly degraded thereby causing quick softening and/or melting of the film. Therefore, the film can fairly and faithfully follow even very complicated and deeply hollowed portions of the original pattern at the time of molding without development of any substantial residual strain. In addition, the intermolecular ionic bonds can be revived by cooling the film after the molding, thereby enabling the film to undergo almost complete plastic deformation. Further, as the tension and percent elongation at softening are both sufficiently large, even a very thin film can fairly undergo molding without any trouble. This results in enhanced fidelity in patterning of the cover film onto the original pattern.

The thickness of the ionomer resin film in accordance with the present invention should preferably be in a range from 10 through 100 microns. When the thickness falls short of 10 microns, breakage of the film tends to occur when subjected to pneumatic suction. Whereas, when the thickness exceeds 100 microns, an excessive quantity of gas is produced at the time of molten metal casting and it is quite difficult to exhaust the excessive quantity of gas so produced completely out of the mold through the granular filler layer via the pneumatic suction. This naturally leads to, in addition to disadvantage in economy, formation of unfavorable gas hole defects in the castings obtained. This further tends to leave non-negligible amounts of burning dregs in the castings. More preferably, the thickness of the ionomer resin film should be in a range from 30 through 70 microns.

As already described, the cover film in accordance with one aspect of the present invention may be made of ionomer resin only. In another preferred embodiment of the present invention, the cover film may be given in the form of a laminated configuration with a film or films of other synthetic resins such as polyamide resin, low-density polyethylene resin and ethylenevinyl acetate copolymer. In the other preferred embodiment of the present invention, the cover film may be given in the form of polymer blends in which ionomer resin is admixed with the above-described other synthetic resins.

In a practical mill production in accordance with the present invention, a cover made of a synthetic film including, at least partly, ionomer resin is subjected to a heat treatment, e.g. at film temperatures from 90° C. through 140° C. for softening, the cover in the softened state is set to the surface of a given original pattern via application of pneumatic suction to the latter, a hollow frame is fixed on the cover, a layer of heat resisting granular fillers such as molding sands is formed in the frame on the cover, pneumatic suction is applied to the layer of the heat resisting granular fillers for solidification thereof and suction of the cover thereto and the original pattern is removed from the mold so prepared.

In practice of the molding process in accordance with the above-described aspect, it was further confirmed by the inventors of the present invention that the cover film including ionomer resin is apt to undergo deformation when molten metal is cast into the mold cavity. This is assumed to be caused by a fact that ionomer resin is a thermoplastic resin and loses its mechanical strength when softened. Thus, friction of the molten metal flow with the weakened cover film causes easy deformation of the latter.

It is a further object of the present invention to provide a method for manufacturing a mold for metal casting in which unfavourable deformation of the cover film through contact with molten metal is well prevented.

In accordance with another preferred aspect of the present invention, a cover made of a synthetic film including, at least partly, ionomer resin is subjected to a heat treatment for softening, the cover in the softened state is then set to the surface of a given original pattern via application of pneumatic suction to the latter, the exposed surface of the cover is coated with a solution of an initial condensate of a thermosetting resin, a hollow frame is fixed on the coated surface of the cover, a layer of heat resisting granular fillers such as molding sand is formed in the frame on the coated cover, pneumatic suction is applied to the layer of the heat resisting granular fillers for solidification thereof and suction of the cover thereto and the original pattern is removed from the mold so prepared.

In a further preferred embodiment of the present invention, the coating is made over a thickness in a range from 2 through 100 microns in terms of the resin in solid state.

When a mold prepared in accordance with the abovedescribed other preferred aspect of the present invention is used for metal casting, the ionomer resin cover film is lined with the coating of the initial condensate of a thermosetting resin and, therefore, the ionomer resin cover film is well fortified without degrading the advantageous characteristics of same. As the fortified cover film satisfactorily resists the friction with the molten metal, accidental defrmation of the cover film during metal casting can effectively be prevented. As the molten metal flows into the cavity, the coating of the initial condensate of the thermosetting resin is molten due to the radiant heat emitted by the molten metal, and permeates into the layer of the heat resisting granular fillers layer, forming a solidified shell layer on the surface of the granular fillers layer, thereby effectively preventing deformation of the ionomer resin cover film during metal casting. This also effectively prevents mixing of the granular fillers into the molten metal. In addition, use of the thermosetting resin coating has an advantage that, as the molten metal comes in contact with the ionomer resin cover film, the thermosetting resin coating in molten state is absorbed into the granular fillers layer together with the ionomer resin cover in molten state and functions as a kind of binder for the granular fillers.

As for the initial condensate of the thermosetting resin used in the present invention, it is required that the coating is molten and set when the molten metal is in the vicinity of the ionomer resin cover though not in contact therewith as yet. It is further preferred that, when the molten metal comes into contact with the ionomer resin cover, the coating is burned, absorbed into the granular fillers layer and bonds the granular fillers to each other.

For example, an alcohol solution of an initial condensate of a thermosetting resin such as phenol, furan and urea resins is preferably suited for use in the present invention. Solvents other than alcohol such as organic solvents, water and mixtures thereof can be used in the present invention also.

However, use of alcohol as the solvent for the initial condensates of thermosetting resins assures successful maintenance of wettability of the coating solution which falls short of the critical surface tension of the cover film, i.e. about 40 dyne/cm.

As already described, the thickness of the coating should preferably be in a range from 2 through 100 micrometers in terms of the resin in solid state. When the thickness falls short of 2 micrometers, the coating cannot form the shell layer to an extent sufficient to prevent possible breakdown of the mold cavity when the molten metal is cost. Whereas, when the thickness exceeds 100 microns, burning dregs of the initial condensate of the thermosetting resin remain between the molten metal and the granular fillers layer, thereby degrading the texture of the castings obtained. In addition, when the thickness of the coating is maintained within the abovedescribed range, a similar good effect can be expected even when a uniform layer of the initial condensate is not formed but the initial condensate is spotted on the surface of the ionomer resin cover film.

Figure 2:
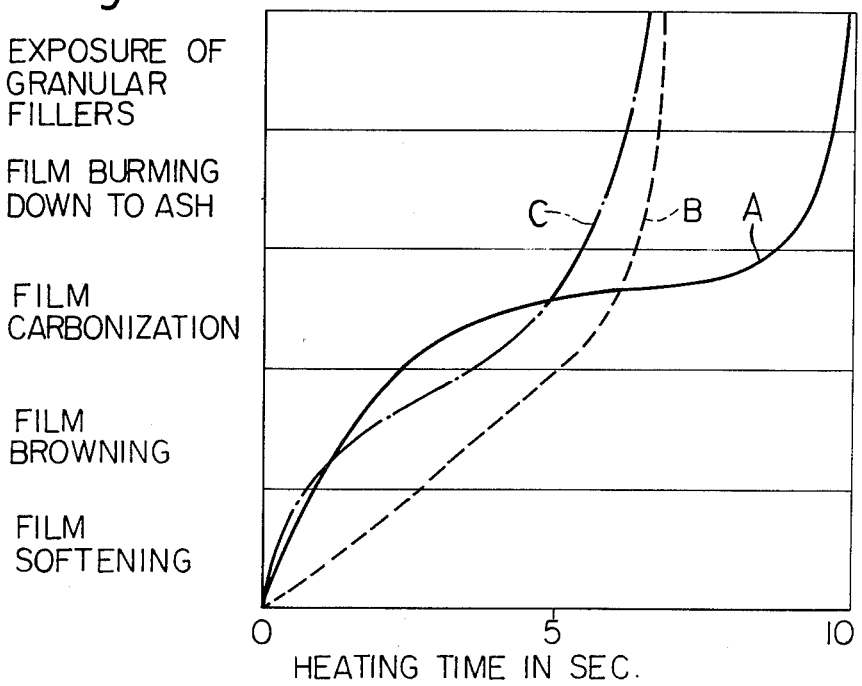
Figure 3A:
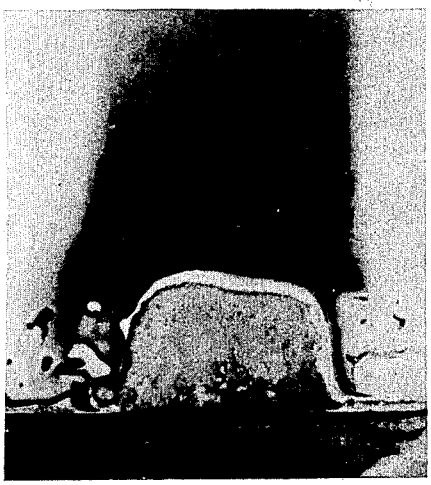
Figure 3B:
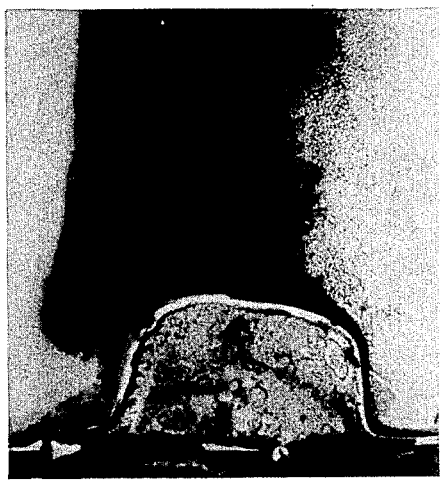
Figure 3C:
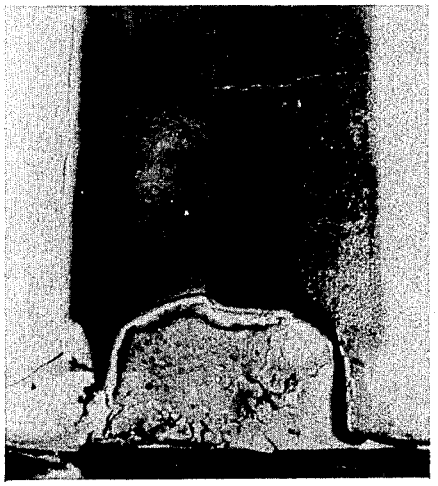
Figure 4:
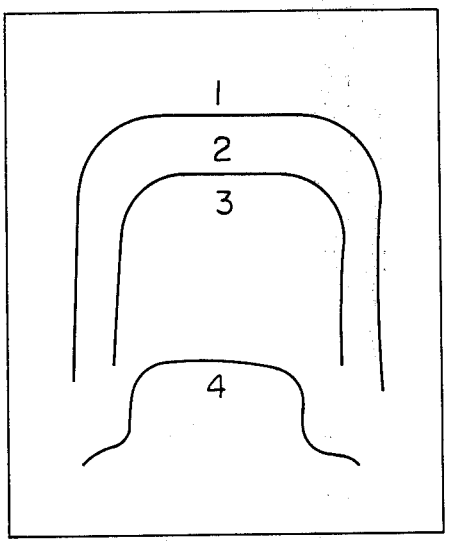

The following examples are illustrative of the present invention but are not to be construed as limiting the same, reference being made to the accompanying drawings, in which;

FIG. 1 is a graph for showing the relationships between heating times and percent elongations of the specimen cover films used in example 1, FIG. 2 is a graph for showing the relationships between heating times and conditions of the specimen cover films used in example 2, FIGS. 3A through 3C are photos for showing conditions of specimen cover films used in example 3 after heating over 5 seconds, and FIG. 4 is an explanatory drawing for the conditions of the films shown in FIGS. 3A through 3C.

EXAMPLE 1

Specimen films of 20 cm. width, 50 mm. effective length and 100 micrometers thickness were made of ionomer resin (surlyn produced by duPont), low density polyethylene resin and ethylene-vinyl acetate copolymer resin, respectively, and subjected to thermal stability tests.

The specimen films were heated for prescribed length of times at a position 20 cm. remote from a plate heater of 400° C. temperature and subjected to stretching at 3 cm./sec. stretching speed. The stretching was carried out in one direction only and the results of the tests are shown in FIG. 1, in which percent elongation is plotted along the ordinate and heating time in seconds is dotted on the abscissa. The curve A is for the ionomer resin film, the curve B for the low density polyethylene resin film and the curve C for the ethylenevinyl acetate copolymer resin.

As is clear from the graph, the percent elongation of the ionomer resin film is by far more stable than those of the other two films.

EXAMPLE 2

Specimen films which are the same as those used in Example 1 were used and changes due to a heat treatment were observed. The specimen films were upheld for prescribed length of times at a postion 0.5 cm. remote from molten metal of 1,300° C. temperature. The results observed are given in FIG. 2 in which changes in the films are plotted along the ordinate and heating times are slotted along the abscissa. Just like as in example 1, the curve A is for the ionomer resin film, the curve B for the low density polyethylene resin film and the curve C for the ethylene-vinyl acetate copolymer resin film. As is clear from the drawing, the ionomer resin film is quickly carbonized from the filmy state and retains the carbonized state for a relatively long period, thereby effectively functioning as a kind of binder for the granular fillers of the mold.

EXAMPLE 3

Specimen films the same as those used in the foregoing examples were subjected to heating for 5 seconds and the resultant dispostions of them are shown in FIGS. 3A through 3C and FIG. 4, in which the softened portions of the films are designated with a reference numeral 1, the brown portions of the films with a reference numeral 2, the carbonized portions with a reference numeral 3 and the molten metal with a reference numeral 4. FIG. 3A shows the result for the ionomer resin film, FIG. 3B for the low density polyethylene resin film and FIG. 3C for the ethylene-vinyl acetate copolymer resin film. It will be well observed that, in the case of the ionomer resin film, the film is carbonized till a portion closest to the molten metal. In contrast to this, other films are burnt down to ash even at positions remote from the molten metal.

EXAMPLE 4

Specimen films the same with as those used in the foregoing examples were subjected to measurements of the mechanical and chemical properties which are in general required for cover films for metal casting. The results of the measurements are shown in Table I.

Table I

| Film | Ethylene-vinyl acetate copolymer resin (17% VAC) | Low density polyethylene resin (M68) | Ionomer resin type 1 (Sarlyn 1707 | Ionomer resin type 2 (Sarlyn 1652) |
|---|---|---|---|---|
| Thermal decomposition temperature in °C. | 250 | 350 | 350 | 350 |
| Softening temperature in °C. | 150 | 190 | 190 | 190 |
| Maximum percent elongation at softening | 75 | 105 | 825 | 600 |
| Tensile strength at breakage in g. | 10 | 8.7 | 17 | 3 |
| Resistance against breakage in time | 2.5 | 2 | 10 | 7 |
| Patterning in time | 5 at 100 microns thickness | 5 at 100 microns thickness | 5 at 50 microns thickness | 5 at 60 micrometer thickness |
| Carbonization | medium | little | much | much |

From the results shown in the table, it is clear that the ionomer resin film is almost equal to the polyethylene resin film but superior to the ethylene-vinyl acetate copolymer resin film with regard to its thermal decomposition temperature and that the ionomer resin film is by far superior to the other resin films when other properties are concerned.

EXAMPLE 5

A pattern of 300 mm. length, 100 mm. width and 150 mm. heigth accompanied with a sprue runner was used for molding and synthetic resin films such as listed in Table II were used for the cover films. After preparation of the lower mold half, an upper mold half of a flat configuration was formed using the same cover film in each case. A pouring gate of 15 mm. diameter was formed in the upper mold half in known manner. Silica sand of 200 micron meters peak mesh were used as the heat resisting granular fillers and pneumatic suction was carried out at 360 Torr. vacuum pressure. Molten gray pig iron of about 1,400° C. temperature was cast into the confined mold and left for cooling down to the atomospheric temperature. The surfaces of the obtained castings were cut off to a depth of 2.0 mm. and the presence of casting defects was observed.

Table II

| Properties | Fidelity in patterning (Suctionable minimum thickness without breakage in micron meters) | Casting defects | | | |
|---|---|---|---|---|---|
| Resins used for films | | metal Penetrations | gas-hole defects | sand marks or sand inclusion | mold breakdown |
| Low density | | ob- | | | ob- |

Table II-continued

| Properties | Fidelity in patterning (Suctionable minimum thickness without breakage in micron meters) | Casting defects | | | |
|---|---|---|---|---|---|
| Resins used for films | | metal Penetrations | gas-hole defects | sand marks or sand inclusion | mold breakdown |
| polyethylene | 100 | served | 2 | 10 | served |
| Ethylene Vinyl acetate copolymer | 75 | a little observed | 1 | 5 | observed |
| Ionomer | 40 | none | 0 | 0 | none |
| Polyamide | 60 | none | 1 | 7 | observed |
| Polyester | no successful suction | — | — | — | — |
| Polypropylene | 90 | observed | 3 | 11 | observed |
| Polyvinyl acetate | no successful suction | — | — | — | — |

It will be clearly understood from the results enlisted that employment of the present invention assures production of castings of remarkably enhanced quality.

What is claimed is:

1. Improved metal casting process by vacuum molding comprising the steps of: heating a cover film including, at least partly, an ionomer resin for softening, setting said cover film in the softened state upon the surface of a given pattern via application of pneumatic suction to the latter, placing a hollow frame in position on said cover film set onto said surface of said original pattern by the applied suction, forming a layer of heat resisting granular fillers within said frame on said cover film applying pneumatic suction to said layer of said granular fillers, removing said original pattern after complete solidification of said granular fillers, to provide a mold having a cavity therein, and casting molten metal in said cavity, whereby the cover film first melts before being contacted by the molten metal and permeates the granular filler layer due to the pneumatic suction and is then quickly carbonized to provide the mold with adequate permeability.

2. Improved method as claimed in claim 1 in which said cover film is made of said ionomer resin only.

3. Improved method as claimed in claim 1 in which said cover film is made of said ionomer resin admixed with an other synthetic resin.

4. Improved method as claimed in claim 1 in which said cover film is made of one or more ionomer resin films laminated with another synthetic resin film.

5. Improved method as claimed in claim 1 in which said ionomer resin has a chemical composition wherein metallic ions link molecular chains of copolymers of α-olefine with copolymerizable unsaturated carboxylic acid.

6. Improved method as claimed in claim 5 in which said copolymerizable unsaturated carboxylic acid is chosen from a group consisting of acrylic acid, methacrylic acid and maleic acid.

7. Improved method as claimed in claim 1 in which the thickness of said cover film is in a range from 10 through 100 microns.

8. Improved method as claimed in claim 7 in which the thickness of said cover film is in a range from 30 through 70 microns.

9. Improved method as claimed in claim 1 further comprising coating the exposed surface of said cover film set to said pattern with a solution of an initial condensate of a thermosetting resin in advance to mounting of said hollow frame.

10. Improved method as claimed in claim 9 in which said thermosetting resin is chosen from a group consisting of phenol, furan and urea resin.

11. Improved method as claimed in claim 9 in which a solvent for said thermosetting resin is chosen from a group consisting of alcohol, other organic solvents, water and mixtures thereof.

12. Improved method as claimed in claim 9 in which coating of said initial condensate of said thermosetting resin is made over a thickness in a range from 2 through 100 microns in terms of said resin in solid state.

* * * * *

UNITED STATES PATENT AND TRADEMARK OFFICE

CERTIFICATE OF CORRECTION

PATENT NO. : 4,157,109

DATED : June 5, 1979

INVENTOR(S) : Atsushi Toyoda and Hiroshi Kasai

It is certified that error appears in the above-identified patent and that said Letters Patent are hereby corrected as shown below:

In the Drawings:

Cover Sheet, change "BURMING" to --BURNING--;

Sheet No. 1, in Fig. 2, change "BURMING" to --BURNING--.

In the Specification:

Column 2, line 64, change "basicially" to --basically--;

Column 3, line 36, change "through" to --though--;

Column 3, line 64, change "is" to --are--;

Column 4, line 17, change "chose" to --choose--;

Column 5, line 12, delete "by" (second occurrence);

Column 6, line 22, the word "is" is illegible;

Column 6, line 65, change "abovedescribed" to --above-described--;

Column 7, line 49, change "cost" to --cast--;

Column 7, line 55, change "abovedescribed" to --above-described--;

UNITED STATES PATENT AND TRADEMARK OFFICE

CERTIFICATE OF CORRECTION

PATENT NO. : 4,157,109

DATED : June 5, 1979

INVENTOR(S) : Atsushi Toyoda and Hiroshi Kasai

It is certified that error appears in the above-identified patent and that said Letters Patent are hereby corrected as shown below:

Column 8, lines 37 and 38, change "example" to --Example--;

Column 9, line 9 (Table I), change "Sarlyn" to --Surlyn-- (two occurrences);

Column 10, the top portion (heading) overlaps the bottom portion of column 9;

Column 10, line 56, change "an other" to --another--.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*